US006170173B1

(12) United States Patent
Caston

(10) Patent No.: US 6,170,173 B1
(45) Date of Patent: Jan. 9, 2001

(54) METHOD AND APPARATUS FOR FLUID FLOW TRANSFER IN SHOES

(76) Inventor: Gayford Caston, 506 Burlington Ave., Durham, NC (US) 27707

( * ) Notice: Under 35 U.S.C. 154(b), the term of this patent shall be extended for 0 days.

(21) Appl. No.: 09/314,429

(22) Filed: May 18, 1999

(51) Int. Cl.[7] ..... A43B 7/06; A43B 7/20; A43B 7/14; A61F 5/14

(52) U.S. Cl. ..... 36/29; 36/3 B; 36/89; 36/141; 36/147; 36/153; 36/35 B

(58) Field of Search ..... 36/29, 35 B, 3 B, 36/3 A, 3 R, 89, 141, 147, 153

(56) References Cited

U.S. PATENT DOCUMENTS

| | | | | |
|---|---|---|---|---|
| 231,830 | * | 8/1880 | McDonald | 36/3 B |
| 1,498,838 | * | 6/1924 | Harrison, Jr. | 36/3 B |
| 1,852,883 | * | 4/1932 | Gustaveson | 36/29 |
| 2,545,062 | * | 3/1951 | Whittington | 36/3 B |
| 2,676,422 | * | 4/1954 | Crawford | 36/3 B |
| 4,446,634 | * | 5/1984 | Johnson et al. | 36/29 |
| 5,375,346 | * | 12/1994 | Cole et al. | 36/29 |
| 5,416,986 | * | 5/1995 | Cole et al. | 36/29 |
| 5,443,529 | * | 8/1995 | Phillips | 36/29 |
| 5,524,364 | * | 6/1996 | Cole et al. | 36/29 |
| 5,625,964 | * | 5/1997 | Lyden et al. | 36/29 |
| 5,907,911 | * | 6/1999 | Huang | 36/29 |
| 5,918,381 | * | 7/1999 | Landry | 36/3 B |

* cited by examiner

*Primary Examiner*—Paul T. Sewell
*Assistant Examiner*—Anthony Stashick
(74) *Attorney, Agent, or Firm*—Charles Edison Smith

(57) ABSTRACT

A method and apparatus for transferring the flow of fluid through tubes in the sole of shoes. The apparatus includes a pair of fluid filled tubes along the periphery of the sole of the shoe. One tube is connected to cross tubes that provide flow paths and cushions the for the ball and instep portions of the foot. The other tube is connected to cross tubes that provide flow paths and cushions heel portion of the foot. Adjustable pressure valves interposed between the fluid filled tubes permit a method of controlling the flow of fluid through the valves in one direction only. The pressure resistance of the valves are pre-set for a certain internal pressure level required for triggering the transfer of fluid from one tube to the other. The method include steps of controlling pressure resistance by adjusting valve pressure adjustment rings either in a clockwise direction about a rod for increasing internal pressure resistance, or in a counter-clockwise direction for decreasing internal resistance.

7 Claims, 2 Drawing Sheets

METHOD AND APPARATUS FOR FLUID FLOW TRANSFER IN SHOES

BACKGROUND OF THE INVENTION

1. Field of the Invention

This invention relates to transfer of fluid to achieve shock absorption in footwear, and in particular, relates to fluid transfer for shock absorption and ankle support adjustable to compensate for differences in shoe size or body-weight of a user.

2. Background of the Prior Art

The basic concept of shock absorption in shoes with transfer of fluid between the heel to the ball portion of a user's foot has been known as illustrated in previously issued U.S. Patents. For example, U.S. Pat. No. 4,312,140 by Reber discloses a device to facilitate pedestrians comprising a heel cavity that is connected via a feedback tube to a cavity located in the front part of the sole of a shoe. The '140 patent teaches that when the heel impacts the ground the compression results in a closing of the feedback tube which is connected to a first reservoir which includes a first one-way valve thus causing a decrease in the inner volume. As a result of this decrease of volume, pressure inside the first reservoir increases. The specification explains that when this pressure reaches a certain value, the first one-way valve opens, so that the pressurized fluid under pressure can now flow through the tube and be stored, while a second controlled one-way valve remains closed. Intensity of reaction of the device may be adapted to the body-weight of the person wearing the shoes. During what is described as a second phase, the rear and front parts of the bottom part of the shoe are both simultaneously touching the ground. In this second phase, the device remains in the state reached at the end of the first phase, which means that a certain quantity of fluid under pressure is stored in intermediate storage means.

Another example of footwear having improved shock absorption is illustrated in U.S. Pat. No. 4,446,634 by Johnson et al. The '634 patent discloses a shoe containing fluid in both a shock absorption bladder in a heel portion and ball portion of the shoe. When walking and in most running, when the heel strikes the ground or support surface, the force in the heel portion will force fluid to flow in only one direction through a regulating valve. As the weight of the user is transferred from the heel portion to the ball portion of the foot, fluid is forced from the ball bladder through another regulating valve. Fluid can flow from the ball bladder to the heel bladder and vice versa, only in one direction, because of the orientation of check valves. This permits fluid to flow from bladder to bladder and prohibits fluid flowing in the opposite direction. The rate at which fluid flows from the heel bladder to the ball bladder and vice versa, can be adjusted by the operation of regulating valves.

U.S. Pat. No. 5,375,346 by Cole et al. discloses a shoe construction having heel and metatarsal bulges molded in the outer sole to define fluid-containing cavities. The bulges engage the ground as the wearer of the shoe is standing. The air in the cavities provides a cushioning effect. In walking and running, the heel bulge first comes in contact with the ground causing air in the cavity to be compressed and forced through a first passageway into the metatarsal cavity. As the heel portion lifts off the ground and the metatarsal bulge contacts the ground, the air in the metatarsal cavity is forced through a second passageway back into the heel cavity to give a lifting effect. Thus, in walking and running, the air alternates back and forth between the cavities.

The foregoing references are not exhaustive but illustrative of the state of the art and suggest that transfer of fluid can be employed to achieve shock absorption in footwear. The prior art however has not recognized or provided a solution to successfully apply the principle of fluid transfer for ankle support in shoes generally and particularly in running shoes. In addition, prior art fluid transfer devices are constructed based upon predetermined conditions applicable regardless of variations in shoe size or weight of the user.

What is needed is shock absorption footwear to facilitate metered fluid transfer throughout the foot and ankle, thus providing support for a user. It is also desirable to design a method and apparatus for pre-determining the compression pressure level to accomplish fluid transfer based upon the weight or shoe size of a person wearing the shoe.

The foregoing prior art references nowhere teach use of a combination of features in shoe structure that will provide the advantages of cushioning and shock absorption in separate regions of the foot in addition to providing support for the shoe wearer. Additionally, the prior art does not provide shoe structure capable of a quick and simple technique to vary and adjust the pressure within a fluid cavity corresponding to the weight or shoe size of the wearer.

The advantages of the present invention include the use of a forward and a rear tube cavity that extend around the perimeter of the shoe. The forward tube extends from approximate the in-step or arch region to the toe of a user and intersects with a plurality of transversely extending metatarsal inlets or projections. The forward tube is linked to the rear tube through pressure sensitive check valves. The rear tube extends around the shoe perimeter from approximate the in-step to the heel of a user, intersecting with a plurality of transversely extending arch inlets and a plurality of upwardly extending projections that surround and support the ankle of a user. The internal pressure within the forward and rear tubes is pre-determined based upon the weight or shoe size of the person wearing the shoe.

Other advantages of the invention will be apparent from the following description, the accompanying drawings and the appended claims.

SUMMARY OF THE INVENTION

The present invention relates to a method and apparatus for transferring a continuous flow of fluid from the heel portion to the toe portion of a shoe. The fluid transfer apparatus is constructed between the sole and the shoe inner sole. One important aspect of the invention is the feature that the weight of the person wearing the shoe compresses tubes that define two separate air tight chambers, causing fluid within the chambers to transfer from one chamber to the next. A first chamber located in the toe and metatarsal portions of the sole comprises a front outer tube extending around the perimeter of the shoe from the toes to the arch region. The front outer tube connects and intersects with a plurality of transversely extending inlets or projections. A second chamber located beyond the instep and in the heel portion of the sole comprises a rear outer tube extending around the perimeter of the shoe from the arch region to the heel. The rear outer tube connects with and intersects a plurality of transversely extending inlets and a plurality of upwardly extending projections that surround the ankle area.

Another essential design feature involves the amount of pressure resistance the two ball type check valves connecting the chambers are designed to withstand. Pressure resistance is pre-determined and set in accordance with the weight of the person wearing the shoe, which usually corresponds with the shoe size. Adjustable pressure valves are used to maintain an airtight connection between the front and rear outer tubes. The valves are arranged and oriented to permit transfer of fluid from one chamber into another only in one direction.

DETAILED DESCRIPTION OF PREFERRED EMBODIMENTS OF THE INVENTION

Figure 1:
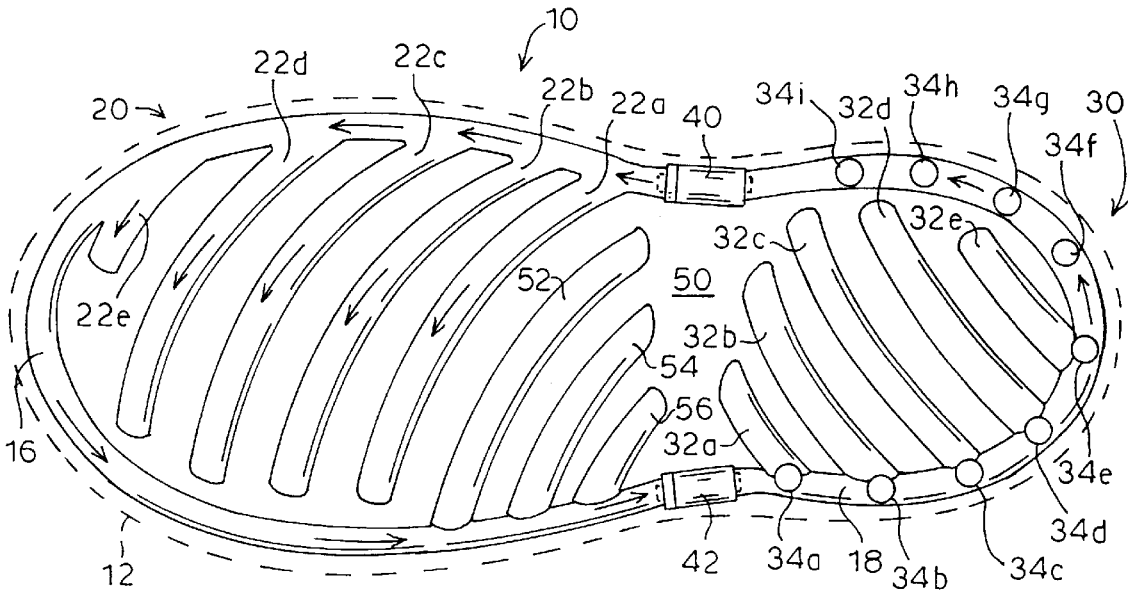
FIG. 1 is a cut away top view of the air transfer shoe of the present invention shown in dotted outline with transfer chambers, inlets, channels and pressure valves shown in solid line disposed within the shoe.

Referring to the drawings, and initially to FIG. 1, a preferred embodiment of the fluid transfer shoe 10 of the invention is illustrated generally. Fluid transfer shoe 10 has an outer sole 12 and a front chamber 20 that receives and supports the forward part of the foot of a user above outer sole 12. Front chamber 20 has a fluid filled outside toe periphery tube 16 and a plurality of ball of foot cross tubes or front bubble inlets 22*a*, 22*b*, 22*c*, 22*d*, and 22*e*. Each of the ball of foot cross tubes or front bubble inlets 22*a*–22*e* connects with front chamber 20 providing a plurality of fluid flow paths within fluid transfer shoe 10, from outside toe periphery tube 16 for providing a cushion for the phalanges or toes including the ball portion of the foot of the user.

Still referring to FIG. 1, fluid transfer shoe 10 has a rear chamber 30 that receives and supports the rear part of the foot of the user above outer sole 12. Rear chamber 30 has a fluid filled outside heel periphery tube 18 and a plurality of heel cross tubes or rear bubble inlets 32*a*, 32*b*, 32*c*, 32*d*, and 32*e*. Each of the heel cross tubes or rear bubble inlets 32*a*–32*e* connects with outside heel periphery tube 18 providing a plurality of fluid flow paths within fluid transfer shoe 10 from outside heel periphery tube 18 across the heel portion of the foot of a user. While outside toe periphery tube 16 and outside heel periphery tube 18 may optimally be filled with air, for example, any suitable fluid may be used.

Referring still to FIG. 1, the entrance to front chamber 20 and the outlet from rear chamber 30 are connected by an adjustable front chamber pressure valve 40 interposed between outside toe periphery tube 16 and outside heel periphery tube 18. The outlet from front chamber 20 and the entrance to rear chamber 30 are connected by an adjustable rear chamber pressure valve 42 interposed between outside toe periphery tube 16 and outside heel periphery tube 18. Fluid transfer shoe 10 also includes a plurality of arch cross tubes or arch bubble inlets in the instep or arch region 50 comprising outside arch bubble inlet 52, center arch bubble inlet 54 and inside arch bubble inlet 56. Arch cross tubes or arch bubble inlets 52, 54 and 56 cushion the middle, metatarsus part of the user's foot that forms the instep.

Figure 2:
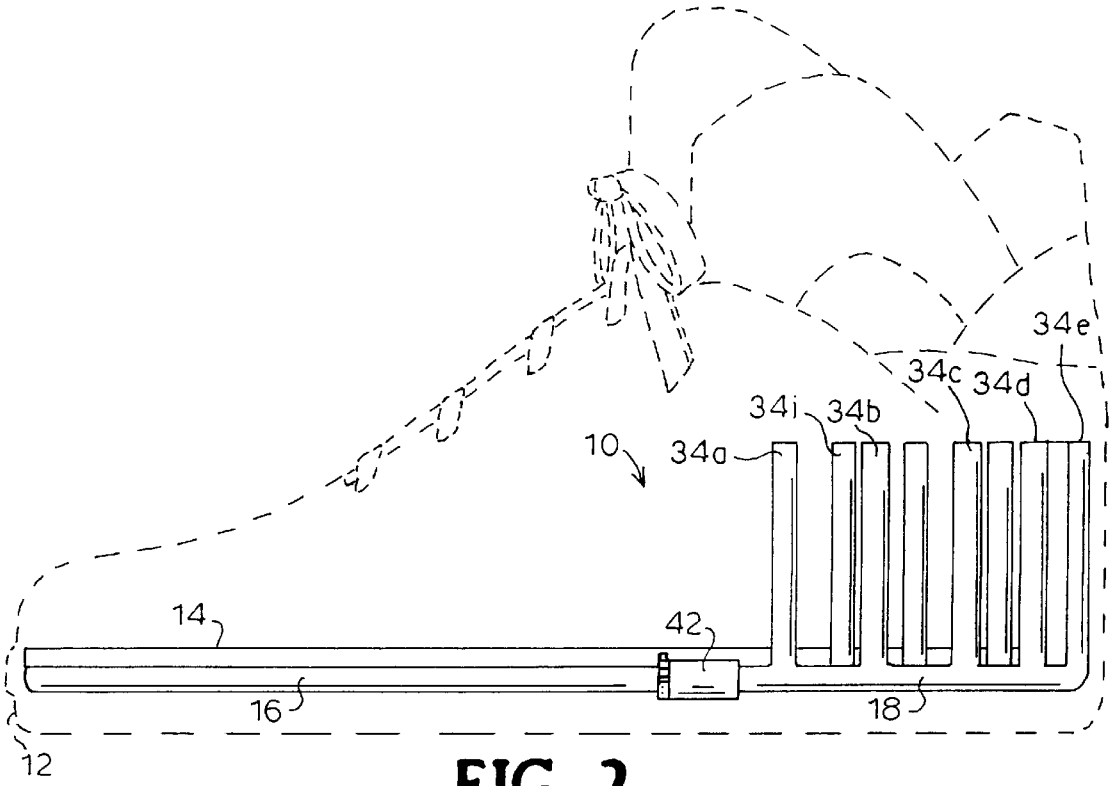
FIG. 2 is a left side elevation view of the air transfer shoe shown in dotted outline with the periphery tubes, ankle channels, innersole and adjustable pressure valves of the present a invention shown in solid line.

Referring now to FIG. 1 and FIG. 2, fluid transfer shoe 10 has a plurality of ankle support tubes or ankle channel fingers 34*a* 34*i* formed integral with outside heel periphery tube 18. The ankle channel fingers 34*a*–34*i* surround the ankle and stabilize the foot of the user. Fluid flow from outside heel periphery tube 18 is distributed to heel cross tubes or front bubble inlets 32*a*–32*e* and ankle channel fingers 34*a*–34*i* as the rear chamber 30 is compressed. Access to front chamber pressure valve 40 and rear chamber pressure valve 42 is provided via a removable inner sole 14 disposed within fluid transfer shoe 10 above front chamber pressure valve 40 and rear chamber pressure valve 42 and adjacent front chamber 20, toe periphery tube 16, ball of foot cross tubes or front bubble inlets 22*a*–22*e*, rear chamber 30, heel cross tubes or rear bubble inlets 32*a*–32*e*, and arch cross tubes or arch bubble inlets 52, 54 and 56.

Figure 3B:
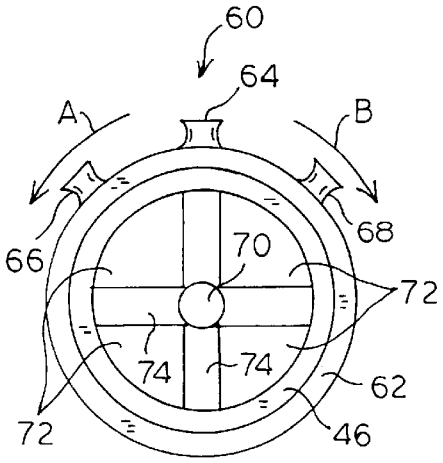
FIG. 3B is an enlarged end view of the adjustable pressure valve of the present invention shown in FIG. 3A.
Figure 3A:
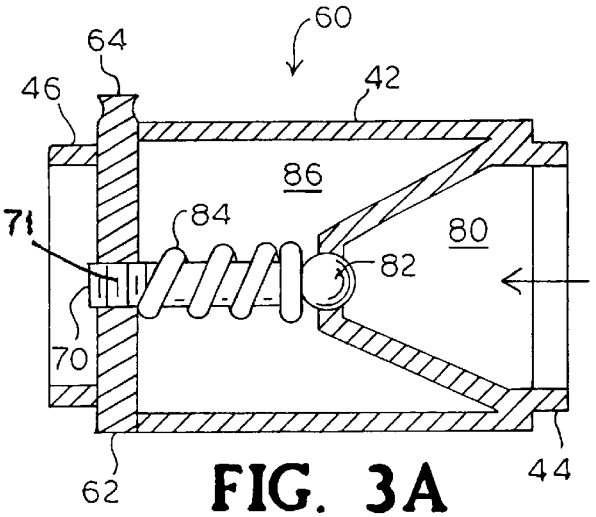
FIG. 3A is an enlarged cross section view of the adjustable pressure valve of the present invention having the pressure adjust ring, and tension spring.

FIG. 3A and FIG. 3B show details of an adjustable pressure valve system 60 according to this invention. Adjustable pressure valve system 60 includes adjustable front chamber pressure valve 40 and adjustable rear chamber pressure valve 42, both of identical construction. Hence, although only adjustable rear chamber pressure valve 42 is shown, it is implicit that features and construction described and illustrated in FIGS. 3A and 3B are equally applicable for adjustable front chamber pressure valve 40. As seen in FIG. 3A, adjustable pressure valve system 60 includes adjustable rear chamber pressure valve 42 that may be formed of a rigid material such as plastic. Adjustable rear chamber pressure valve 42 is designed to function as a one way valve to permit flow of fluid through adjustable front chamber pressure valve 40 in the direction indicated by the arrow into an entry channel 80. Adjustable rear chamber pressure valve 42 is provided with a front collar 44 that is maintained in sealing engagement with the entrance to outside heel periphery tube 18. A rear collar 46 is provided on the opposite end of adjustable front chamber pressure valve 42 and is maintained in sealing engagement with the exit from outside toe periphery tube 16. Fluid flow from entry channel 80 into an exit chamber 86 is subject to the amount of resistance provided by a valve ball 82 and resistance spring 84 arrangement mounted on a spiral rod 70 and disposed within exit chamber 86. Spiral rod 70 is formed with one or more spiral threads 71 that receive a pressure adjustment ring 62. Although not specifically shown in the drawings, structure for maintaining valve ball 82 in an air tight seal between entry channel 80 and exit chamber 86, e.g., an O ring with an associated valve seat and the like, entail ordinary mechanical skill. Hence, details of such techniques are not necessary to understand that adjustable front chamber pressure valve 42 is capable of achieving an airtight connection.

Still referring to FIG. 3A, valve ball 82 is shown resiliently biased to a normally closed position by resistance spring 84 to seal adjustable rear chamber pressure valve 42 when fluid or air pressure pushes against it in the direction of the arrow. Pressure adjustment ring 62 is constructed with open sectors 72 (See FIG. 3B) to permit airflow from exit chamber 86. As seen in both FIG. 3A and FIG. 3B, pressure adjustment ring 62 is provided with a plurality of braces 74 that connect pressure adjustment ring 62 to spiral rod 70. Pressure adjustment ring 62 is formed with a plurality of protuberances or position ridges spaced apart on an outer surface of pressure adjustment ring 62. Protuberance or position ridge 64 is used to designate a normal ridge position for normal pressure operation of adjustable pressure valve system 60 when position ridge 64 is aligned in a vertical orientation with respect to a horizontal plane.

Adjustable rear chamber pressure valve 42 is constructed with a specified internal resistance to fluid pressure based upon the weight of a user for normal pressure operation. When the pressure reaches a certain value, adjustable rear chamber pressure valve 42 functioning as a controlled one-way valve, opens so that fluid now flows from outside toe periphery tube 16 through Adjustable rear chamber pressure valve 42 into outside heel periphery tube 18 and the various inlets and channels, while another controlled one-way valve, adjustable front chamber pressure valve 40 remains closed.

For illustrative purposes, in a first example, assume a user between 170–195 pounds corresponds with a 9.5 to 11.0 shoe size. When the 170–195 pound user walks or runs, and when the 9.5–11.0 shoe strikes the ground surface 26, an applied force of about 562 pounds of pressure per square foot is generated. Thus, for this example, adjustable front chamber pressure valve 40 and adjustable rear chamber pressure valve 42 are constructed to withstand internal fluid or air pressure caused by an applied force of 562 pounds of pressure per square foot. To withstand an applied force of 562 pounds of pressure per square foot, the shoe is initially constructed with resistance spring 84 set at the desired value and with position ridge 64 aligned in a vertical orientation with respect to a horizontal plane.

In another example, assume a user between 196 224 pounds corresponds with an 11.5 to 13.0 shoe size. Whenever the 196–224 pound user walks or runs and the shoe strikes the ground or support surface 26, an applied force of about 648 pounds of pressure per square foot is created. Thus, for this second example, adjustable front chamber pressure valve 40 and adjustable rear chamber pressure valve 42 are constructed to withstand an internal fluid pressure caused by an applied force of 648 pounds of pressure per square foot. To withstand an applied force of 648 pounds of pressure per square foot, for this example, the shoe is initially constructed with resistance spring 84 set at the desired value and with position ridge 64 aligned in a vertical orientation with respect to a horizontal plane.

In yet another example, assume a user between 135–169 pounds corresponds with a 7.5 to 9.0 shoe size. Whenever the 135–169 pound user walks or runs and the 7.5 9.0 shoe strikes the ground or support surface 26, an applied force of 468 pounds of pressure per square foot is created. Thus, for this third example, adjustable front chamber pressure valve 40 and adjustable rear pressure valve 42 are constructed to withstand an internal fluid pressure caused by an applied force of 468 pounds of pressure per square foot. For this example, to withstand an applied force of 468 pounds of pressure per square foot, the shoe is initially constructed with resistance spring 84 set at the desired value and with position ridge 64 aligned in a vertical orientation with respect to a horizontal plane.

Referring now to FIG. 3B, protuberance or position ridge 66 is used to designate a ridge position for an increase from normal pressure operation of adjustable pressure valve system 60 when position ridge 66 is aligned in a vertical orientation with respect to a horizontal plane. For illustrative purpose, assume that at the time of purchase a user weighs between 170–195 pounds, but since has gained weight up to about 196–224 pounds. Or, alternatively, suppose that a user weighs between 196–224 pounds, but has a foot that corresponds with a 9.5 to 11.0 shoe size. When the 196–224 pound user walks or runs, and when the 9.5 11.0 shoe strikes the ground or support surface 26, an applied force is created greater than the pre-set 562 pounds of pressure per square foot. Thus, the internal pressure of adjustable front chamber pressure valve 40 and adjustable rear chamber pressure valve 42 may be adjusted to withstand an internal air pressure caused by an applied force of up to 648 pounds of pressure per square foot. This is accomplished by manipulation of adjustment ring 62 about spiral rod 70 so that position ridge 66 is aligned in a vertical orientation with respect to a horizontal plane. To align position ridge 66 in a vertical orientation with respect to a horizontal plane, the user may simply use an object to engage and move position ridge 64. Hence, users simply moves ridge 64 and thereby pressure adjustment ring 62 about spiral rod 7 clockwise in the direction of arrow B until position ridge 66 is aligned in the vertical position.

In another example, assume that at the time of purchase a user weighs between 196–224 pounds, but since has gained weight up to about 225 250 pounds. Or, alternatively, suppose that a user weighs between 225–250 pounds, but has a foot that corresponds with an 11.5 to 13.0 shoe size. When the 225–250 pound user walks or runs, and when the 11.5 to 13.0 shoe strikes the ground or support surface 26, an applied force is created greater than the pre-set 648 pounds of pressure per square foot. Thus, the internal pressure of adjustable front chamber pressure valve 40 and adjustable rear chamber pressure valve 42 may be both adjusted to withstand an internal pressure caused by an applied force of up to 732 pounds of pressure per square foot. This is accomplished by manipulation of adjustment ring 62 about spiral rod 70 so that position ridge 66 is aligned in a vertical orientation with respect to a horizontal plane. To align position ridge 66 in a vertical orientation with respect to a horizontal plane, the user may simply use an object to engage and move position ridge 64, and thereby pressure adjustment ring 62 about spiral rod 70, clockwise in the direction of arrow B until position ridge 66 is aligned in the vertical position.

In another example, assume that at the time of purchase a user weighs between 135–169 pounds, but since has gained weight up to about 170–195 pounds. Or, alternatively suppose that a user weighs between 170–195 pounds, but has a foot that corresponds with a 9.5 to 11.0 shoe size. When the 170–194 pound user walks or runs, when the 9.5 to 11.0 shoe strikes the ground surface, an applied force is created greater than the pre-set 468 pounds of pressure per square foot. Thus, the internal pressure of adjustable front chamber pressure valve 40 and adjustable rear chamber pressure valve 42 may be adjusted to withstand an internal pressure caused by an applied force of up to 562 pounds of pressure per square foot. This is accomplished by manipulation of adjustment ring 62 about spiral rod 70 so that position ridge 66 is aligned in a vertical orientation with respect to a horizontal plane. To align position ridge 66 in a vertical orientation with respect to a horizontal plane and increase the resistance from 468 pounds per square inch to 562 pounds per square inch, position ridge 64 may be manipulated. The user may simply use an object to engage and move position ridge 64, and thereby pressure adjustment ring 62 about spiral rod 70, clockwise in the direction of arrow B until position ridge 66 is aligned in the vertical position.

Still referring to FIG. 3B, protuberance or position ridge 68 is used to designate a ridge position for a decrease from normal pressure operation of adjustable pressure valve system 60 when position ridge 68 is aligned in a vertical orientation with respect to a horizontal plane. For illustrative purpose, assume that at the time of purchase a user weighs between 170–195 pounds, but since has lost weight and is down to about 135–169 pounds. Or, alternatively, suppose that a user weighs between 135–169 pounds, but has a foot that corresponds with a 9 to 11.5 shoe size. When the 135–169 pound user walks or runs, and when the 9–11.5 shoe strikes the ground or support surface 26, an applied force less than the pre-set 562 pounds of pressure per square foot required for fluid flow transfer is created. To facilitate fluid or air flow transfer, internal pressure resistance of adjustable front chamber pressure valve 40 and adjustable rear chamber pressure valve 42 may be adjusted downward from 562 pounds to facilitate fluid flow transfer caused by an applied force of about 468 pounds of pressure per square foot. Optimally, this is accomplished by manipulation of adjustment ring 62 about spiral rod 70 so that position ridge 68 is aligned in a vertical orientation with respect to a horizontal plane. To align position ridge 68 in a vertical orientation with respect to a horizontal plane, the user may simply use an object to engage and move position ridge 64 to the desired position. Thus, the user moves position ridge 64, and thereby pressure adjustment ring 62 about spiral rod 70, counter-clockwise in the direction of arrow A until position ridge 68 is aligned in the vertical position.

In still another example, assume that at the time of purchase a user weighs between 196–224 pounds, but since has lost weight and is down to about 174–195 pounds. Or, alternatively, suppose that a user weighs between 174–195 pounds, but has a foot that corresponds with an 11.5 to 13.0 shoe size. When the 174–195 pound user walks or runs, and when the 11.5 to 13 shoe strikes the ground surface, an applied force less than the pre-set 648 pounds of pressure per square foot required for air flow transfer is created. To facilitate fluid or air flow transfer, internal pressure resistance of adjustable front chamber pressure valve 40 and adjustable rear chamber pressure valve 42 may be adjusted downward from 648 pounds to facilitate fluid flow transfer caused by an applied force of about 562 pounds of pressure per square foot. This is accomplished by manipulation of adjustment ring 62 about spiral rod 70 so that position ridge 68 is aligned in a vertical orientation with respect to a horizontal plane. To align position ridge 68 in a vertical orientation with respect to a horizontal plane, the user may simply use an object to engage and move position ridge 64, and thereby pressure adjustment ring 62 about spiral rod 70, counterclockwise in the direction of arrow A until position ridge 68 is aligned in the vertical position.

In yet another example, assume that at the time of purchase a user weighs between 135–169 pounds, but since has lost weight and is down to 110–134 pounds. Or, alternatively suppose that a user weighs between 110–134 pounds, but has a foot that corresponds with a 7.5 to 9.0 shoe size. When the 110–134 pound user walks or runs and when the 7.5 to 9.0 shoe strikes the ground or support surface 26, an applied force less than the pre-set 468 pounds of pressure per square foot required for air flow transfer is created. To facilitate air flow transfer, internal pressure resistance of adjustable front chamber pressure valve 40 and adjustable rear chamber pressure valve 42 may be adjusted downward from 468 pounds per square inch to facilitate fluid flow transfer caused by an applied force of about 376 pounds of pressure per square foot. This is accomplished by manipulation of adjustment ring 62 about spiral rod 70 so that position ridge 68 is aligned in a vertical orientation with respect to a horizontal plane. To align position ridge 68 in a vertical orientation with respect to a horizontal plane, the user may simply use an object to engage and move position ridge 64, and thereby pressure adjustment ring 62 about spiral rod 70, counter-clockwise in the direction of arrow A until position ridge 68 is aligned in the vertical position.

Figure 4:
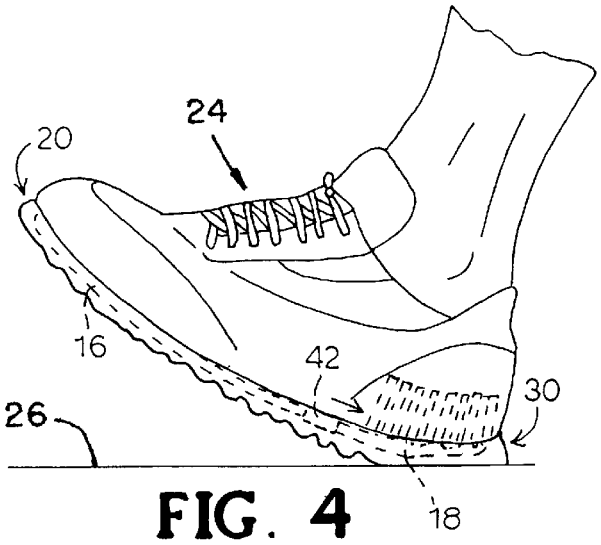
FIG. 4 is a side elevation view of the fluid transfer shoe as worn by a user showing how the heel portion of the foot first hits a support surface with the heel periphery tube being compressed.
Figure 5:
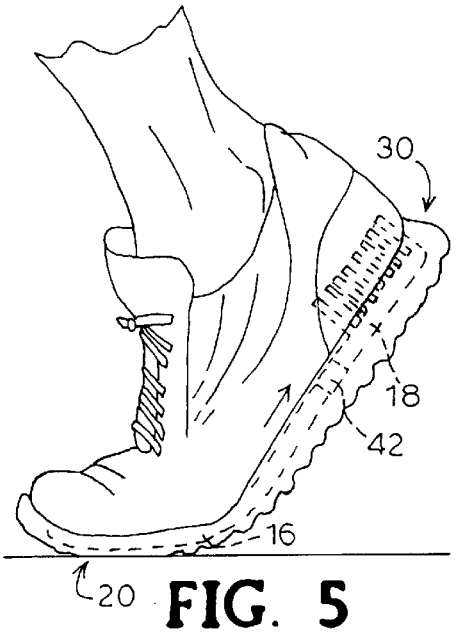
FIG. 5 is a side elevation view of the fluid transfer shoe when the weight of the user is on the ball portion of the foot with the toe periphery tube being compressed.

FIGS. 4 and 5 in conjunction with FIGS. 1, 2 and 3A–3B illustrate operation of the fluid transfer shoe 10. FIG. 4 shows fluid transfer shoe 10 on a user's foot 24 and during the phase when the heel strikes the ground or support surface 26, fluid in the rear chamber 30 provides a cushioning effect. The weight of the user causes fluid in rear chamber 30 including outside heel periphery tube 18 and heel cross tubes or rear bubble inlets 32*a*–32*e* to be compressed and forced in the direction indicated by the arrow through adjustable front chamber pressure valve 40 into front chamber 20. The pressure at which fluid flows from rear chamber 30 through adjustable front chamber pressure valve 40 into front chamber 20 is predetermined in accordance with the weight of the user which usually corresponds with the shoe size. This pressure level can be adjusted through adjustable pressure valve system 60 by rotation of pressure adjust ring 62.

FIG. 5 illustrates the phase when the user's foot moves from a completely flattened position to the position that the foot begins to push off with the toes flexed and the heel lifting from the ground or support surface 26. The weight of the user causes fluid in front chamber 20, including outside toe periphery tube 16 and ball of foot cross tubes or front bubble inlets 22*a*–22*e*, to be compressed and forced in the direction indicated by the arrow through adjustable rear chamber pressure valve 42 into rear chamber 30. The pressure at which fluid flows from front chamber 20 through adjustable rear chamber pressure valve 42 into rear chamber 30 is predetermined in accordance with the weight of the user which may correspond with shoe size. This internal pressure level that is required for fluid flow transfer can be adjusted either upward or downward through adjustable pressure valve system 60 by rotation of pressure adjust ring 62.

It will be evident to those skilled in the art that a great many variants of the foregoing airflow transfer system may equally well be employed to adapt a air flow transfer system responsively to different compressive forces and weights. Additionally, it should be recognized that the changing of the ranges of airflow transfer is to be construed as being within the ambit of the appended claims.

What is claimed is:

1. A fluid flow transfer system for shoes comprising:

a. an outer sole;

b. a front chamber that receives and supports a forward part of a foot of a user above said outer sole;

c. a fluid filled outside toe periphery tube connected to said front chamber and extending throughout the outer perimeter of the shoe;

d. a plurality of front cross tubes connected to said toe periphery tube, each of said plurality of front cross tubes connected to said front chamber, thereby providing a plurality of fluid flow paths within said fluid flow transfer system from said outside toe periphery tube thereby providing a cushion for phalanges and ball portion of said foot of said user;

e. a rear chamber that receives and supports a rear part of a foot of a user above said outer sole; said front chamber and said rear chamber positioned in immediate and direct fluid communication alignment;

f. a fluid filled outside heel periphery tube connected to said rear chamber and extending throughout the outer perimeter of the shoe;

g. a plurality of rear cross tubes connected to said heel periphery tube, each of said rear cross tubes connected to said rear chamber thereby providing a plurality of transversely extending fluid flow paths within said fluid flow transfer system from said outside heel periphery tube thereby providing a cushion for a heel portion of said foot of said user;

h. a plurality of upwardly extending ankle support tubes formed integral with said outside heel periphery tube providing a direct fluid communication path adjacent an ankle area thereby stabilizing a foot of said user; and i. means for adjusting internal pressure within said front and rear chambers and in said toe and heel periphery tubes in accordance with weight or shoe size of said user.

2. The fluid flow system for shoes of claim 1 wherein said fluid filled outside toe periphery tube contains air sealed and compressed within said outside toe periphery tube.

3. The fluid flow transfer system for shoes of claim 1 wherein said fluid filled outside heel periphery tube contains air sealed and compressed within said outside heel periphery tube.

4. The fluid transfer system for shoes of claim 1 wherein an entrance to said front chamber and an outlet from said rear chamber are connected by an adjustable front chamber pressure valve interposed between said outside toe periphery tube and said outside heel periphery tube.

5. The fluid flow transfer system for shoes of claim 4 wherein an outlet from said front chamber and an entrance to said rear chamber are connected by an adjustable rear chamber pressure valve interposed between said outside toe periphery tube and said outside heel periphery tube.

6. The fluid flow transfer system for shoes of claim 5 further comprising a plurality of cross tubes in an instep of said foot of said user, said plurality of cross tubes in said instep providing a cushion for a middle part of said foot of said user.

7. A fluid flow transfer system for shoes of claim 6 further comprising an adjustable pressure valve system having at least one pressure valve constructed and designed to permit flow of fluid through in one direction only.

* * * * *